United States Patent [19]

Quantz

[11] Patent Number: 4,652,027

[45] Date of Patent: Mar. 24, 1987

[54] ELECTRICALLY ACTUATED LOCK MECHANISM

[76] Inventor: Norman G. Quantz, 2584 Norway Lake Rd., Lapeer, Mich. 48446

[21] Appl. No.: 797,827

[22] Filed: Nov. 14, 1985

Related U.S. Application Data

[63] Continuation-in-part of Ser. No. 631,466, Jul. 16, 1984.

[51] Int. Cl.[4] ..... E05C 3/26

[52] U.S. Cl. ..... 292/201; 70/241; 292/DIG. 43

[58] Field of Search ..... 292/201, 216, DIG. 43, 292/336.3; 200/61.64, 61.67, 153 L; 70/241

[56] References Cited

U.S. PATENT DOCUMENTS

| | | | |
|---|---|---|---|
| 2,636,949 | 4/1953 | Hunter | 200/153 L X |
| 3,566,703 | 3/1971 | Van Noord | 292/201 X |
| 3,917,330 | 11/1975 | Quantz | 292/201 X |
| 4,468,941 | 9/1984 | Bascov | 292/201 X |
| 4,518,180 | 5/1985 | Kleefeldt et al. | 292/201 |
| 4,569,544 | 2/1986 | Escaravage | 292/201 X |

FOREIGN PATENT DOCUMENTS

| | | | |
|---|---|---|---|
| 755206 | 8/1956 | United Kingdom | 200/153 L |
| 2142078 | 1/1985 | United Kingdom | 292/201 |

*Primary Examiner*—Robert L. Wolfe
*Assistant Examiner*—Russell W. Illich
*Attorney, Agent, or Firm*—Remy J. VanOphem

[57] ABSTRACT

An electrically actuated rear deck lock mechanism which may be locked or unlocked in a conventional manner. The lock mechanism latches the deck lid by engaging a lock bar after closure of the deck lid and through the use of a cam entrapping the lock bar to move it to a locked position. Once in the locked position, the electrical locking mechanism is free of all mechanical forces applied to the latch member such that any forces experienced during normal operation of the vehicle are observed through the mechanical inner lock of the latch with the lock bar without undue effect on the electrical components of the latch. The lock mechanism can also be moved to a locking position without interfering with the electrical locking portion of the mechanism and may be manually unlocked in the event of an electrical power failure.

10 Claims, 28 Drawing Figures

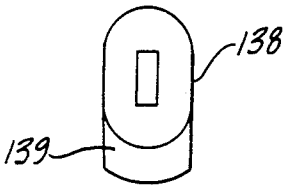
Fig-24
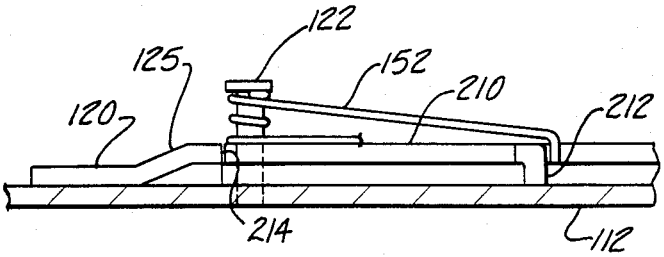
Fig-26
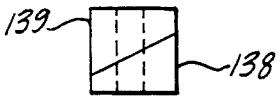
Fig-25
Fig-27
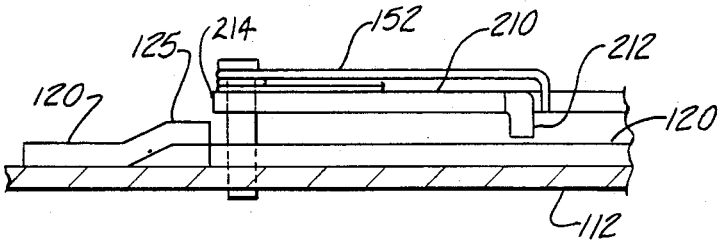
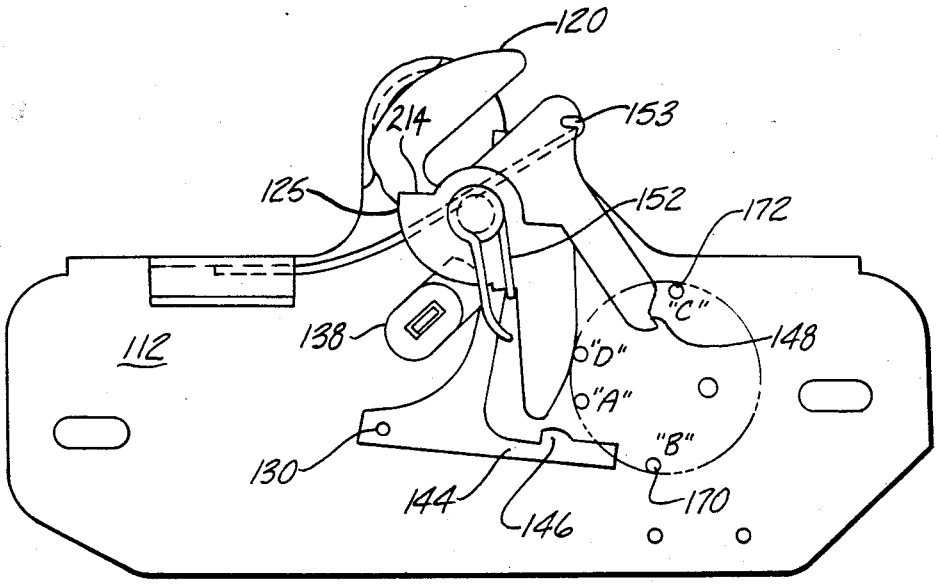
Fig-28

ELECTRICALLY ACTUATED LOCK MECHANISM

CROSS-REFERENCE TO RELATED APPLICATIONS

This application is a Continuation-In-Part of the U.S. patent application Ser. No. 631,466, filed 7-16-84.

BACKGROUND OF THE INVENTION

1. FIELD OF THE INVENTION

The invention is related to electrically actuated lock mechanisms and, in particular, to an electrically actuated lock mechanism for the rear deck lid of an automotive vehicle.

2. DESCRIPTION OF THE PRIOR ART

Lock mechanisms for the rear deck lid of automotive vehicles are well known in the art. In general, most of the rear deck lid locking mechanisms are purely mechanical and incorporate a latch member entrapping a mating member, such as a lock bar. The locking mechanism may be attached to the rear deck lid and the mating lock bar attached to a structural element of the vehicle below the lower extremity of the rear deck lid opening, or the locking mechanism may be attached to a structural member of the vehicle and the lock bar attached to the rear deck lid. Normally, the mechanical locking mechanisms are locked by slamming the rear deck lid closed causing the lock bar to engage the latch member displacing it to a locked position in which the lock bar is entrapped by the latch member. The latch member is mechanically released from its locked position by the rotary motion of a key actuated lock.

In recent years, rear deck lid lock mechanisms have been developed which permit the lock mechanism to be electrically unlatched from inside the vehicle's passenger compartment, as well as externally unlatched by means of the key lock. Typical electrically released rear deck lid lock mechanisms have been disclosed in Quantz, U.S. Pat. No. 3,917,330, and Allen, U.S. Pat. No. 3,504,511. Additionally, power locking mechanisms have been incorporated into the rear deck locking mechanism to displace the latch member to its locked position. Peters, in U.S. Pat. Nos. 3,580,623 and 3,596,484, discloses a hydraulic mechanism for displacing the latch member to the locked position when the rear deck lid is closed. Alternatively, Bellot et al, U.S. Pat. No. 4,395,064, discloses a rear deck having an electric motor connected to a lock member and a latch member by a pair of lost motion links. De Claire et al, U.S. Pat. No. 3,332,713, discloses an electrically driven latch closure having a motor driven rack engaging a toothed sector of the latch member to rotate the latch member between its open and latched position. Oishei, U.S. Pat. No. 3,113,447, and Lentz et al, U.S. Pat. No. 3,016,968, disclose a pneumatically operated latch closure mechanism. Garvey et al, U.S. Pat. No. 2,896,990, discloses a rear deck lid closure mechanism having an electrically driven jack screw for lowering the rear deck lid to its closed position after the latch mechanism has engaged the lock bar.

The invention is an improved rear deck lid lock mechanism which may be unlocked with a conventional key lock or by an electrical actuator remotely actuated from inside the vehicle's passenger compartment and may be latched by forceably slamming the rear deck lid to its closed position causing the latch member to move to its locked position or by lowering the deck lid with a force only sufficient for the lock bar to displace the latch member towards its locked position. The latch member thereafter will be electrically returned to its locked position.

SUMMARY OF THE INVENTION

The invention is an electrically actuated rear deck lid lock mechanism having a support frame, a lock member pivotally attached to the support frame having a first arm with a lock dog, and a latch member pivotally connected to the support frame which is displaceable between an open and locked position. The latch member has a dog catch which engages the lock dog to lock the latch member in the locked position. A catch slot receives a lock bar in its open position and entraps the lock bar in the locked position. Resilient means produce a first force which biases the latch member towards the open position and further produces a second force which biases the lock member to engage the lock dog with the dog catch for pivotally displacing the lock member against the force of the resilient means to thereby disengage the lock dog from the dog catch. The lock mechanism further consists of a cam gear having a cam surface of a predetermined contour, an electric motor for rotating the cam gear, and at least one stud protruding from the cam gear which engages the latch member with the rotation of the cam gear to displace the latch member to its locked position. A cam actuated electrical switch is responsive to the displacement of the latch member from its open position towards its closed position for providing electrical power to the electric motor and responsive to the contour of the cam surface for terminating the electrical power to the electric motor.

One object of the invention is to provide a lock mechanism which may be mechanically or electrically locked or unlocked. Another object of the invention is to provide a lock mechanism in which the electrical locking mechanism does not interfere with the mechanical locking of the lock mechanism. A further object of the invention is to provide a lock mechanism in which the electrical locking mechanism is free of all the mechanical forces applied to the latch member when the latch member is in its locked position.

These and other objects of the invention will become more apparent from reading the specification in conjunction with the drawings appended hereto.

BRIEF DESCRIPTION OF THE DRAWINGS

FIGS. 24 and 25 are plan and front views of the key actuated cam;

FIGS. 26 and 27 are partial side views showing the relationship between the latch member and bypass cam in the engaged and disengaged positions, respectively; and FIG. 28 is a plan view of the locking mechanism with the latch member disengaged from the bypass cam.

DETAILED DESCRIPTION OF THE PREFERRED EMBODIMENT

Figure 1:
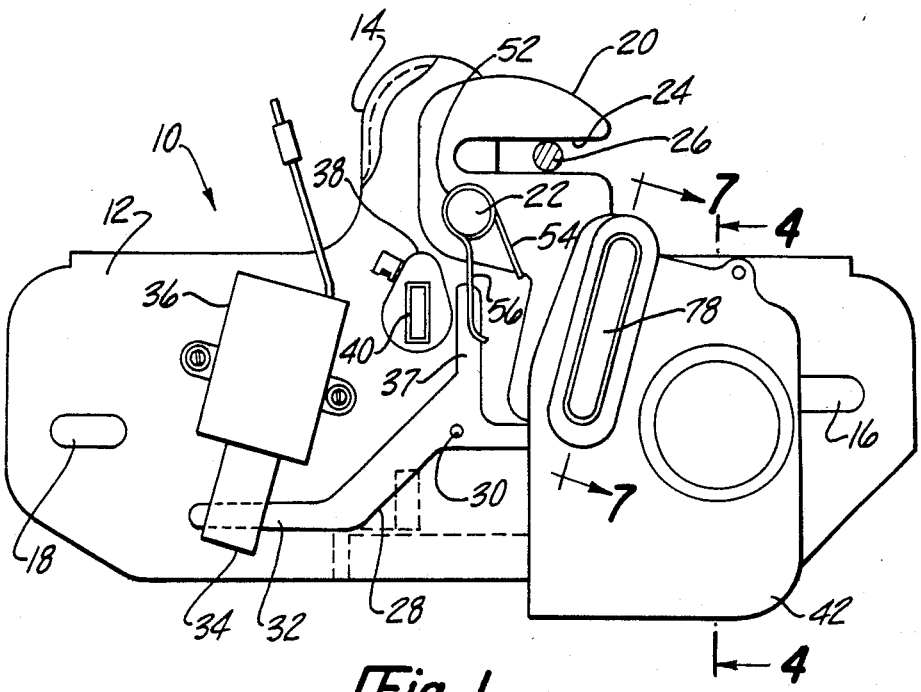
FIG. 1 is a plan view of the rear deck lid lock mechanism in the locked position.

The details of a first embodiment of an electrically actuated rear deck lid lock mechanism 10 are shown in FIGS. 1 through 12. Referring first to FIG. 1, the deck lid lock mechanism 10 includes a support bracket 12 having an extension 14 protruding therefrom, and two mounting slots 16 and 18. As is known in the art, the deck lid lock mechanism may be attached to the vehicle's trunk lid or to a portion of the vehicle's frame just below the trunk lid opening, depending upon the design of the vehicle.

A latch member 20, shown in the locked position, is pivotally connected to a horizontal support bracket 12 by means of a first pivot pin 22. The latch member 20 has a laterally offset catch slot 24 which is located above the horizontal portion of the bracket 12 and captivates a lock bar 26 mounted on the rear deck lid when the latch member 20 is in the locked position, as shown, preventing the rear deck lid from being raised.

Figure 7:
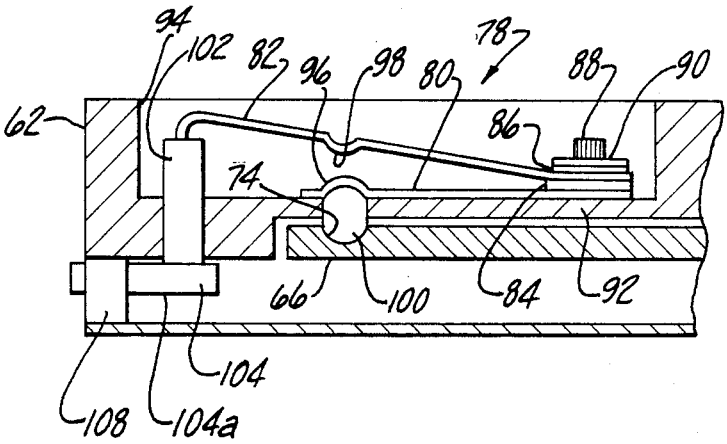
FIGS. 7, 9, 10, and 11 are partial cross-sectional views of the electrical switch showing the position of its elements during various stages of its operational cycle.

A lock member 28 is pivotally connected to the bracket 12 by a second pivot pin 30 and locks the latch member 20 in the locked position as shall be explained with reference to FIG. 2. A leg 32 of the lock member 28 is captivated in an actuator arm 34 of a solenoid 36 attached to the support bracket 12. The solenoid 36 is connected to the vehicle's power supply through a switch (not shown) conveniently located in the vehicle's passenger compartment. The cam 38 has an elongated slot 40 for receiving the elongated extension bar of a manually key operated lock mechanism (not shown) such as is ordinarily provided on the vehicle for manually unlocking the trunk lid. An electrical lock mechanism 42, which has a cam actuated electrical switch mechanism 78 as shown in FIG. 7, automatically returns the latch member 20 to its locked position when the rear deck lid is lowered sufficiently to trip the latch member 20 as shall be explained hereinafter.

Figure 2:
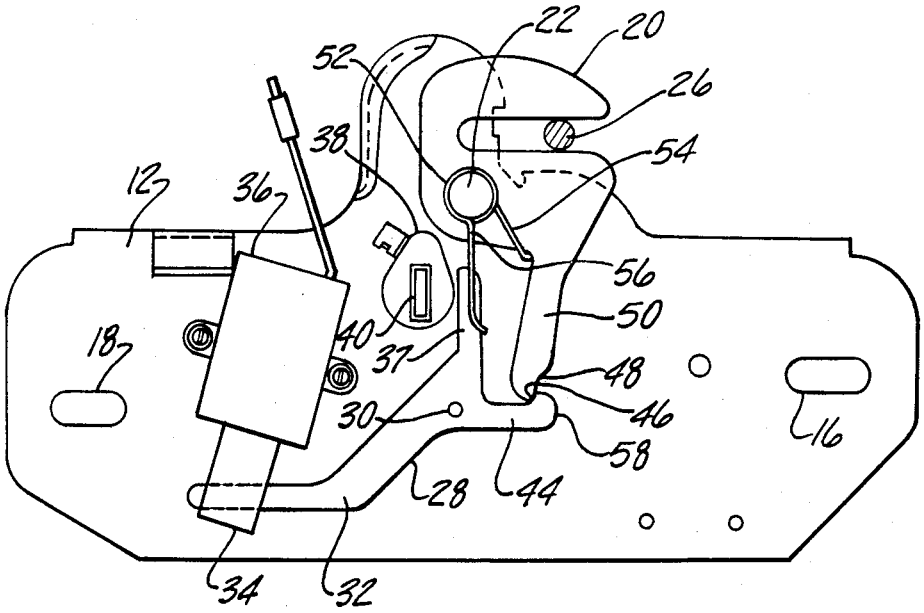
FIG. 2 is a plan view of the lock mechanism in the locked position with the electrical lock mechanism removed.
Figure 3:
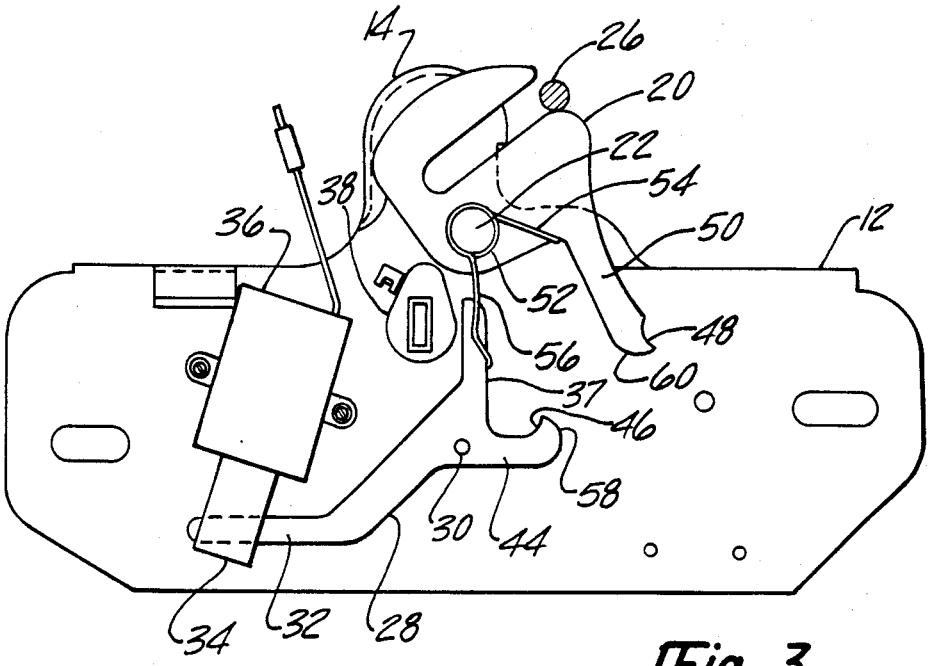
FIG. 3 is a plan view of the lock mechanism in the open position with the electrical lock mechanism removed.

Referring now to FIGS. 2 and 3, the electrical lock mechanism 42 is removed to show the details of the latch member 20 and the lock member 28. The lock member 28 has a second arm 44 extending generally normal to a vertical arm 37. At the end of the second arm 44 is a dog 46 which engages a dog catch 48 provided at the extremity of a lower extension 50 of the latch member 20. A coil spring 52, wound around the first pivot pin 22, has a first leg 54 which engages the latch member 20 below the first pivot pin 22 and produces a force which biases the latch member 20 to rotate in a counterclockwise direction about the first pivot pin 22. A second leg 56 of the coil spring 52 engages the vertical arm 37 of the lock member 28, producing a force biasing the vertical arm 37 of the lock member 28 into engagement with the cam 38 and the dog 46 into engagement with the dog catch 48 of the latch member 20.

Rotation of the cam 38 in a clockwise direction, as viewed in FIG. 2, by means of the manually key operated lock mechanism, or activating the solenoid 36 to retract the actuator arm 34, will rotate the lock member 28 in a clockwise direction disengaging the dog 46 from the dog catch 48 of the latch member 20. The coil spring 52, acting on the latch member 20, will cause the latch member to rotate in a counterclockwise direction to that of the position shown in FIG. 3. As shown in FIG. 3, the lock bar 26 engages the lower surface of the catch slot 24 at a point laterally offset from the first pivot pin 22 such that a force applied to the latch member 20 by the lock bar 26 will tend to rotate the latch member 20 towards the closed position.

Cooperation of an external curved surface 58, opposite the dog 46, and a curved surface 60, opposite the dog catch 48, will cause the lock member 28 to be displaced against the force of the coil spring 52 when a sufficient force is applied to the latch member 20 urging it toward its locked position. Once the dog catch 48 passes the dog 46, the force opposing the coil spring 52 returns the latch member 28 to its locked position with the vertical arm 37 engaging the surface of the cam 38 and the dog 46 engaging the dog catch 48 in order to lock the latch member 20 in its locked position.

Figure 4:
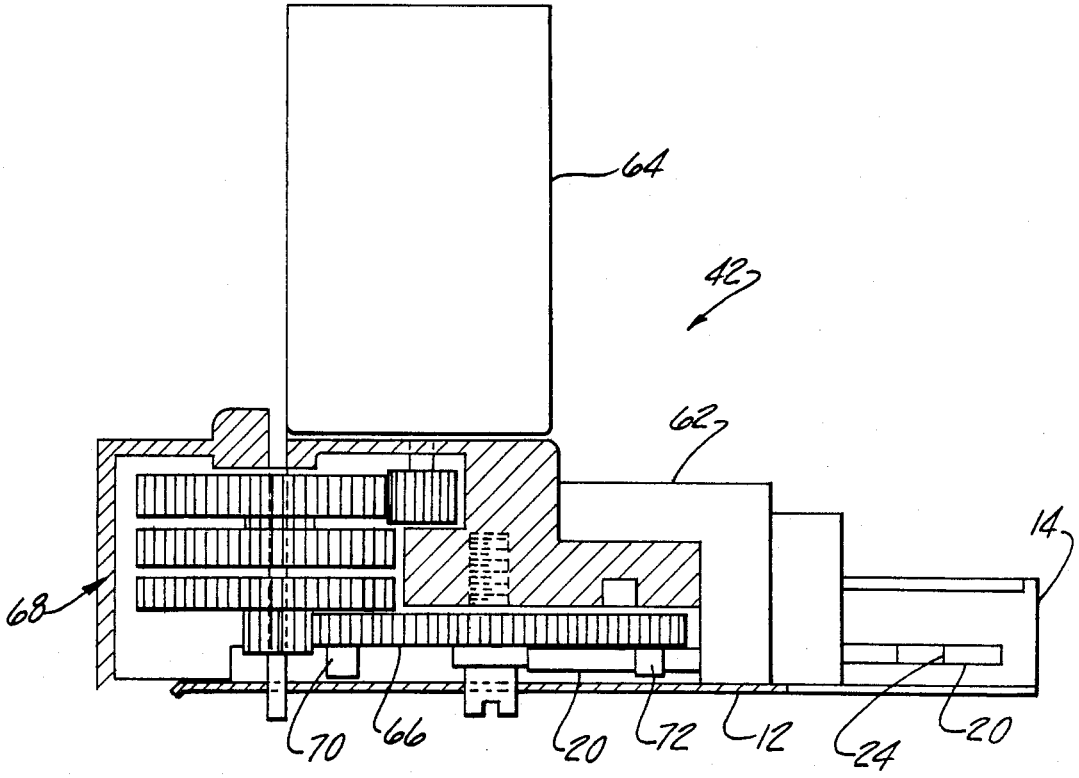
FIG. 4 is a partial cross-sectional view of the electrical locking mechanism taken along lines 4—4 of FIG. 1.

Referring to FIG. 4, the electrical lock mechanism includes a housing 62 attached to the support bracket 12 with a plurality of screws (not shown). Attached to the housing is a fractional horsepower electric motor 64 which drives a cam gear 66 through a series of speed reproduction gears, collectively designated as gear train 68.

A pair of diametrically opposed studs 70 and 72, attached to the cam gear 66, protrude from the cam gear 66 and are operative upon rotation thereof to engage the edge of the latch member 20 and return the latch member 20 to its locked position. The two studs 70 and 72 are provided on the cam gear 66 so that the cam gear 66 only needs to rotate through one half of a revolution during each operating cycle. This reduces the time and electrical power required to complete each locking cycle.

Figure 5:
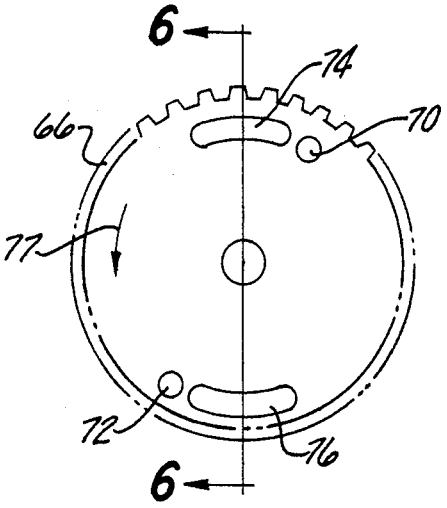
FIG. 5 is a front elevational view of the cam gear.
Figure 6:
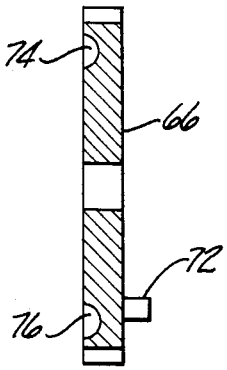
FIG. 6 is a partial cross-sectional view of the cam gear taken along lines 6—6 of FIG. 5.

As shown in FIG. 5, the cam gear 66 also has a pair of diametrically opposed arcuate cam grooves 74 and 76 formed in its upper surface immediately preceding each of the studs 70 and 72 in the control gear's direction of rotation as shown by arrow 77 in FIG. 5. The arcuate cam grooves 74 and 76 cooperate with the cam actuated electrical switch mechanism 78 embodied in the housing 62 of the electrical lock mechanism 42 to lock and reset the switch mechanism.

Figure 9:
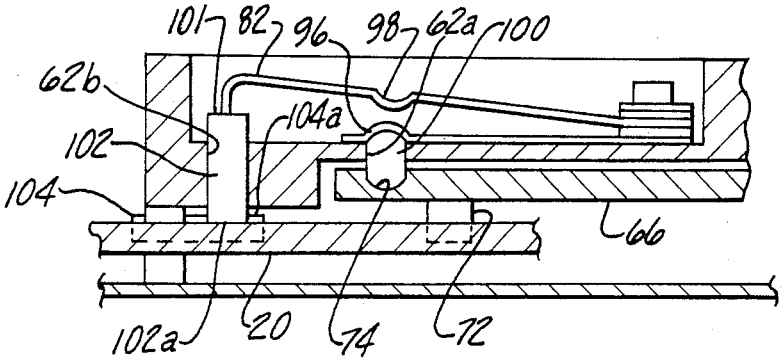
Figure 10:
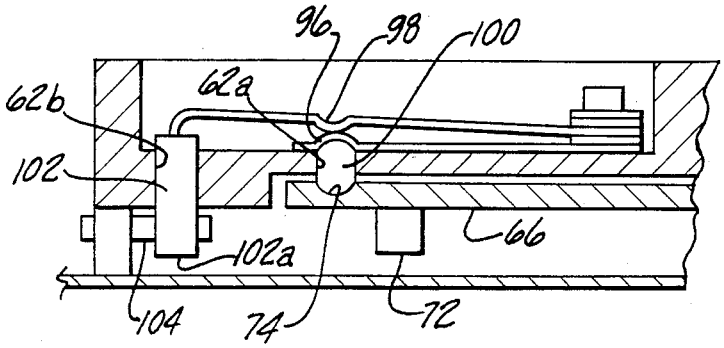
Figure 11:
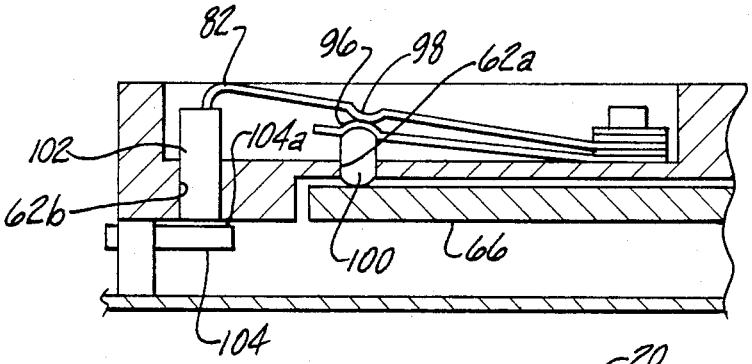

The details of the cam actuated electrical switch mechanism 78 are shown in FIG. 7. In FIG. 7, the cam actuated electrical switch mechanism 78 is shown in an open state, which occurs after the locking cycle is completed, and remains in this state until the rear deck lid is opened. FIGS. 9 through 11 show the state of the cam actuated electrical switch mechanism 78 during sequential stages of the locking cycle. Referring first to FIG. 7, the cam actuated electrical switch mechanism 78 includes a pair of spring contacts 80 and 82, separated at one end by an insulating washer 84. One of the spring contacts 80 and 82 in connected to the vehicle's source of electrical power, such as the vehicle's battery, and the other spring contact is connected to the electric motor 64. A collar 86 insulates a cap screw 88 and washer 90 from the contact springs 80 and 82. The cap screw 88 and the washer 90 clamp the contact springs 80 and 82 to a land 92 formed in the housing 62 at the bottom of an elongated cavity 94. Each of the spring contact 80 and 82 is dimpled to form a pair of opposing electrical contacts 96 and 98, respectively. A cam follower 100 is provided in a first aperture 62*a* formed through the land 92 directly above the path of the opposed arcuate grooves 74 and 76. FIG. 7 shows the cam follower 100 in the arcuate groove 74 formed in the top surface of the cam gear 66. The contact spring 80 produces a force urging the cam follower 100 to engage the bottom of the arcuate cam groove 74 when the contact spring 80 is lying substantially parallel to the surface of the land 92.

Figure 8:
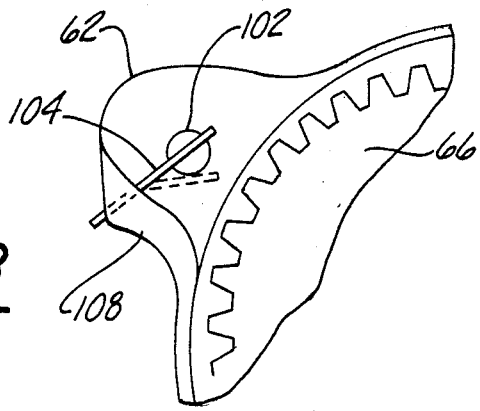
FIG. 8 is a partial view of the housing showing the details of the leaf spring relative to the post.

As shown in FIG. 9, a cylindrical post 102 is attached at one end 101 to the end of the contact spring 82, which is slidably received in a second aperture 62*b* in the land 92. In the open state of the cam actuated electrial switch mechanism 78, the cylindrical post 102 is held in a raised position by a leaf spring 104 engaging in its rest position the other end of the cylindrical post 102. The leaf spring 104 is held in position in the housing by pressing it through a slit formed through a leg 108 of the housing 62, as shown in FIG. 7 and 8. FIG. 8 is a view of a portion of the housing 62 directly below the cylindrical post 102.

As shown, the leaf spring 104, in its rest position, lies directly beneath the cylindrical post 102 and is operatively displaced to the position shown in phantom by the latch member 20 when the latch member 20 is in its open position, as shown in FIG. 3. With the leaf spring 104 displaced, as shown by the phantom line of FIG. 8, the cylindrical post 102 is urged by the contact spring 82 through the second aperture 62*b* in the land 92 to engage the top surface of the latch member 20 as shown in FIG. 9. In this position, the lower surface 102*a* of the cylindrical post 102 is below the upper edge 104*a* of the leaf spring 104, thereby preventing the leaf spring 104 from returning to its rest position when the latch member 20 is subsequently withdrawn from this position by the closing of the rear deck lid. The electrical contacts 96 and 98 remain spatially separated when the bottom of the cylindrical post 102 is resting on the top surface of the latch member 20, as shown in FIG. 9.

When the rear deck lid is closed, the lock bar 26 engages the latch member 20 causing it to pivot in a clockwise direction about the first pivot pin 22, displacing the latch member 20 from below the cylindrical post 102. This permits the spring contact 82 to displace the cylindrical post 102 further down until the electrical contact 98 engages the electrical contact 96, as shown in FIG. 10. When the cylindrical post 102 is in its descended position, the latch member 20 is prevented from returning to its full open position, as shown in FIG. 3, resulting in the lock bar 26 being entrapped in the catch slot 24 even though the rear deck lid is not fully closed. The engagement of the electrical contacts 96 and 98 provides electrical power to the electric motor 64 which initiates the rotation of the cam gear 66. As the cam gear 66 rotates, the cam follower 100 initially rides in the bottom of one of the cam grooves 74 or 76. At the end of the cam groove 74 or 76 the cam follower 100 rises to the top surface of the cam gear 66, as shown in FIG. 11. The raising of the cam follower 100 out of the can grooves 74 or 76 causes it to raise the spring contacts 80 and 82 upwardly, as shown. During the raising of the spring contacts 80 and 82, the electrical contacts 96 and 98 remain engaged with each other and continue to supply electrical power to the electric motor 64. The raising of the contact springs 80 and 82 by the cam follower 100 riding on the top surface of the cam gear 66 lifts the cylindrical post 102 above the upper edge 104*a* of the leaf spring 104 permitting the leaf spring 104 to return to its rest position directly below the lower surface 102*a* of the cylindrical post 102. In this state of the cam actuated electrical switch mechanism 78, the electric motor will continue to rotate the cam gear 66 until the next cam groove is encountered. When the next cam groove is encountered, the cam follower 100 will descend into the next sequential cam groove and the cam actuated electrical switch mechanism 78 will return to its initial state, as shown in FIG. 7, terminating the supply of electrical power by the electric motor 64 and, thereby, terminating the rotation of the cam gear 66.

Figure 12:
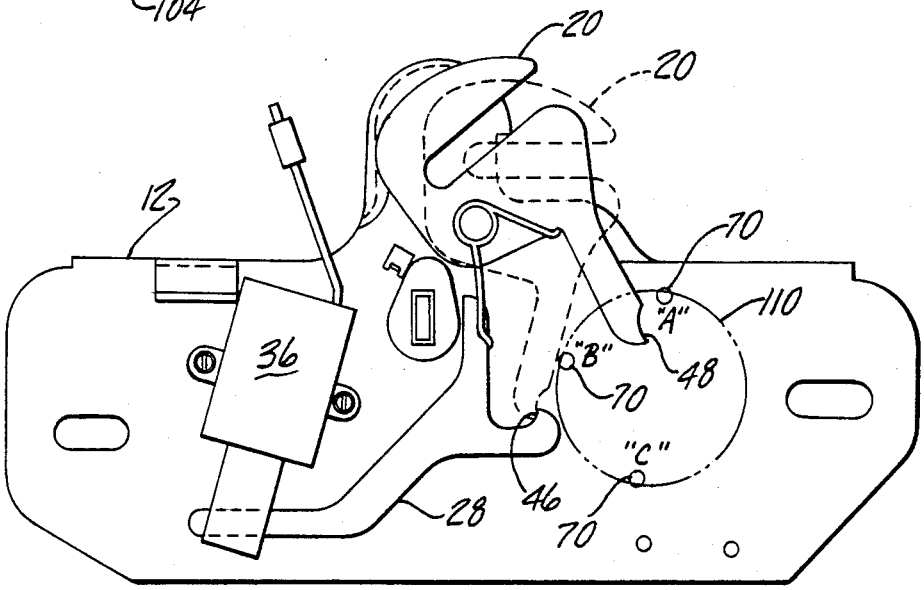
FIG. 12 is a plan view of the lock mechanism showing the path followed by the studs during the rotation of the cam gear.

As previously indicated, the two studs 70 and 72, protruding from the lower surface of the cam gear 66, engage the edge of the open latch member 20 and rotate the latch member in a clockwise direction to its locked position, entrapping the lock bar 26 in the catch slot 24. This is more clearly shown in FIG. 12 in which the circle designated 110 defines the external rotational path of the studs 70 and 72. In FIG. 12, position "A" designates the position of the stud 70 when the cam actuated electrical switch mechanism 78 is in its open position, as shown in FIG. 7. When the cam actuated electrical switch mechanism is closed, the stud 70 will rotate in a counterclockwise direction from position "A" and, after a predetermined rotation of the cam gear 66, will engage the edge of the latch member 20. Continued rotation of the cam gear 66 to position "B" will displace the latch member 20 towards its locked position a distance sufficient to cause the dog 46 of the lock member 28 to engage the dog catch 48 of the latch member 20, as shown in phantom, securing the latch member 20 in its locked position. After the latch member 20 is secured in its locked position, the cam gear 66 will continue to rotate disengaging the stud 70 from the latch member 20. The cam gear 66 will continue to rotate until the cam follower 100 of the cam actuated electrical switch mechanism 78 encounters the cam groove 76 associated with the diametrically opposed stud 72 where the electrical contacts 96 and 98 separate, as shown in FIG. 7. The separation of the electrical contacts 96 and 98 causes the motor to stop with the stud 70 at position "C", which is diametrically opposite to its starting position "A".

The operation of the rear deck lid lock mechanism is as follows:

When it is desired to open the rear deck lid, the operator may either activate the solenoid 36 from a remote location inside of the vehicle or may rotate the cam 38 by means of the manual key operated lock mechanism. Activating the solenoid 36 or rotating the cam 38 rotates the lock member 28 in a clockwise direction, as viewed in FIGS. 2 and 3, disengaging the dog 46 from the dog catch 48, allowing the coil spring 52 to rotate the latch member 20 to its open position. With the opening of the latch member 20, the lock bar 26 displaced upwardly slightly raising the deck lid. The lock bar 26 is now clear of the catch slot 24, permitting the rear deck lid to be raised manually or under the influence of biasing means (not shown). If the rear deck lid is spring-loaded, it will automatically rise to its fully open position. The opening of the latch member 20 also displaces the vertical leaf spring 104 permitting the cylindrical post 102 to descend and engage the top surface of the latch member 20, setting the electrical locking mechanism for its closing cycle.

The rear deck lid may be closed by either of two methods. First, the deck lid may be closed in the conventional manner by applying a force sufficient for the lock bar 26 to rotate the latch member 20 to its locked position with the dog 46 engaging the dog catch 48. In the alternative, the deck lid may be locked only using a force sufficient to displace the latch member 20 away from under the cylindrical post 102 which causes the contacts 96 and 98 of the cam actuated electrical switch mechanism 78 to close and energize the electric motor 64. The electric motor will then drive the cam gear 66 and the stud 70 or 72 will displace the latch member 20 to its locked position as previously described, locking the deck lid in its closed position.

Figure 13:
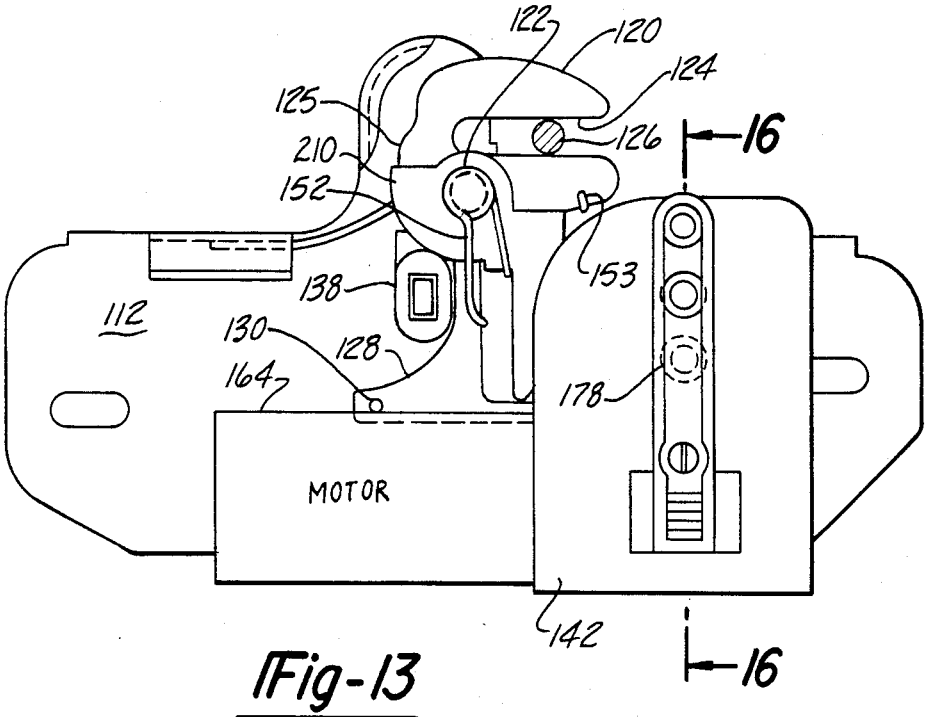
FIG. 13 is a plan view of an alternate embodiment of the lock mechanism.

An alternate embodiment of the electrically actuated rear deck lock mechanism is shown in FIG. 13. This alternate embodiment is functionally similar to the first embodiment shown in FIG. 1, however, the requirement for a solenoid, such as the solenoid 36, to unlatch the lock mechanism has been eliminated and an electrical bypass cam has been added. Referring to FIG. 13, the lock mechanism has a support bracket 112 corresponding to support bracket 12 of the first embodiment and includes a latch member 120 corresponding to the latch member 20 and a bypass cam 210. The latch member 120 and bypass cam are pivotally connected to the support bracket 112 by means of a first pivot pin 122. The latch member 120 has a laterally offset catch slot 124 which captivates the vehicle's lock bar 26 as previously described and a raised dog 125 which engages an edge of the bypass cam 210.

A lock member 128 is pivotally connected to the bracket 112 by a second pivot pin 130 and locks the latch member 120 in its locked position as previously described. A vertical arm 137 of the lock member 128 engages the surface of a key actuated cam 138 rotatably attached to the support bracket 112 as more clearly shown in FIG. 14. The cam 138 has a slot 140 for receiving the extension bar of a manually operated lock mechanism (not shown), such as is normally provided for manually unlocking the rear deck lid lock mechanism. The key actuated cam 138 also has a ramp surface 139 as shown in FIGS. 24 and 25, which lifts the bypass cam 210 disengaging it from the latch member's dog 125, as shall be explained hereinafter. An electrical lock actuator 142, which has an electric motor 164 and a cam actuated single pole double throw switch mechanism 178, automatically returns the latch member 120 to its locked position, as previously described with reference to the first embodiment, and will unlatch the lock mechanism in response to the generation of an electrical unlatch signal.

Figure 14:
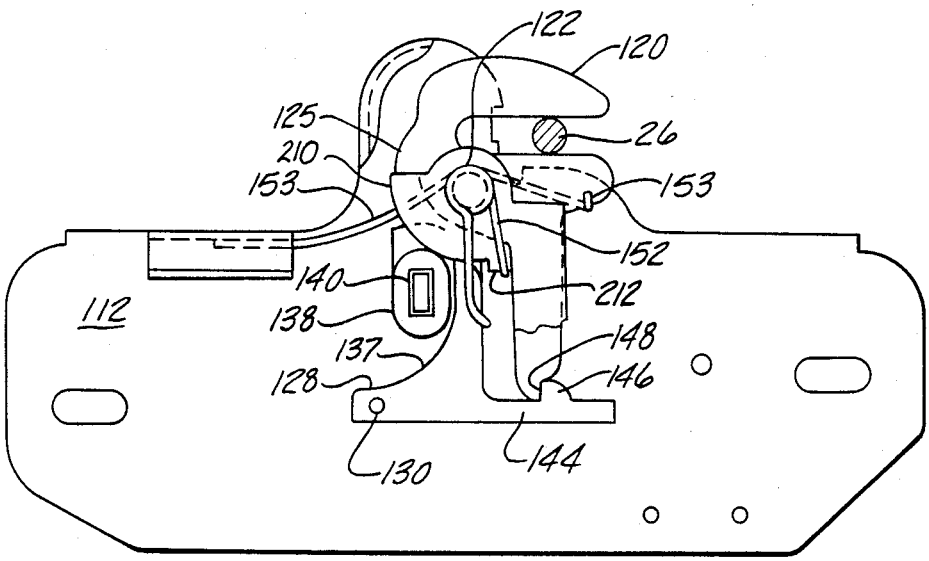
FIG. 14 is a plan view of the alternate embodiment in the locked state with the electrical actuator removed.
Figure 15:
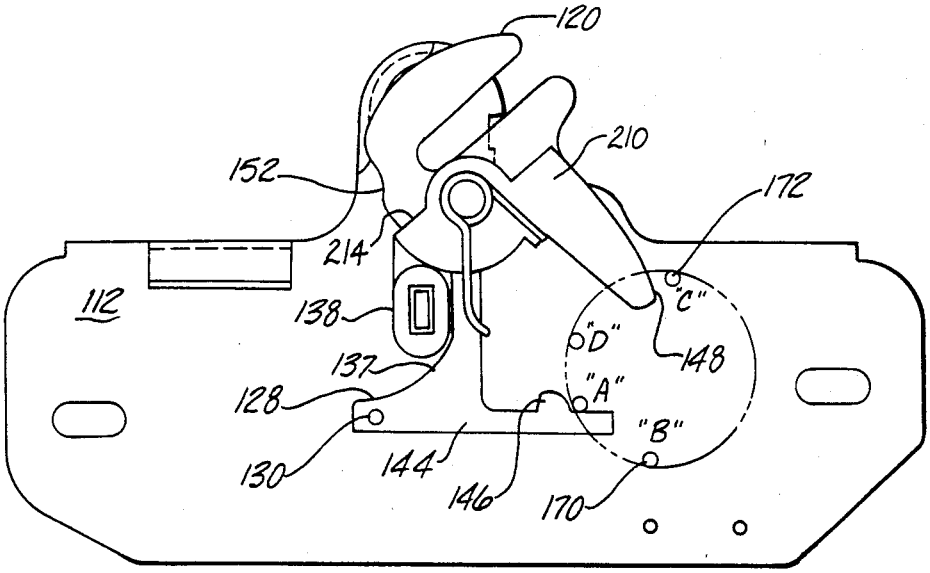
FIG. 15 is a plan view of the alternate embodiment in the unlocked state with the electrical actuator removed.

Referring now to FIGS. 14 and 15, the electrical lock actuator 142 is removed to show the details of the latch member 120, bypass cam 210, and lock member 128. The lock member 128 has a second arm 144 extending generally normal to the vertical arm 137. A dog 146 provided at an intermediate location along the second arm 144 is engaged by a dog catch 148 provided at the extremity of the latch member 120. A coil spring 152, circumscribing the first pivot pin 122, biases the bypass cam 210 to rotate in a counterclockwise direction about the first pivot pin 122 and the lock member 128 into engagement with the cam 138. In the locked position of the lock mechanism, the dog 146 engages the dog catch 148 as shown on FIG. 14 and as previously described with reference to the first embodiment. The coil spring 152 also produces a force biasing the bypass cam 210 towards the latch member 120. The bypass cam 210 has a tab 212 which engages the mating edge of latch member 120 so that the latch member 120 is forced to rotate with the bypass cam 210 in the counterclockwise direction. A second spring 153 independently biases the latch member 120 towards the unlocked position.

Unlatching of the dog catch 148 from the dog 146 may be accomplished mechanically by the manual rotation of the key actuated cam 138 by a key inserted in the rear deck lid lock, or electrically, as shall be explained hereinafter. The locking function of the alternate embodiment is similar to that previously described with reference to the first embodiment.

Figure 16:
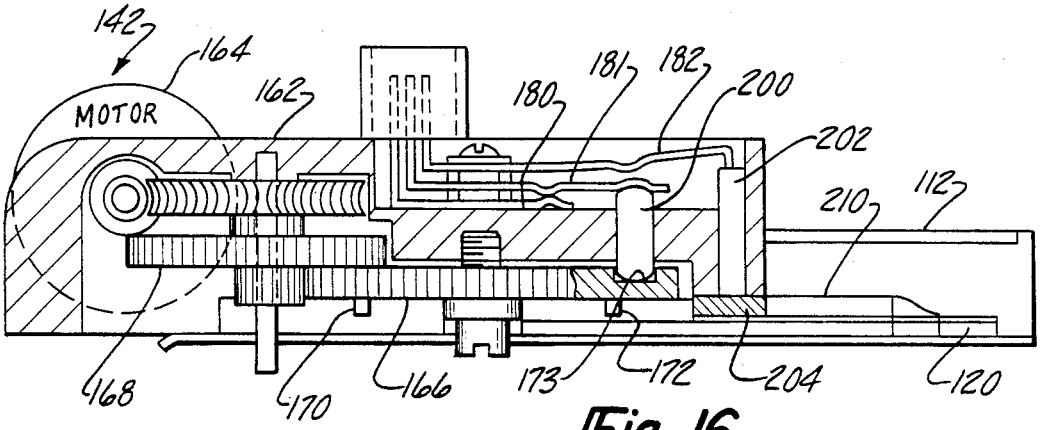
FIG. 16 is a cross-sectional view of the lock mechanism taken through section line 16—16 of FIG. 13.

The details of the electrical lock actuator 142 are shown in FIG. 16. Referring now to FIG. 16 the electrical lock actuator 142 includes a housing 162 which is attached to the support bracket 12 by a plurality of screws (not shown). Attached to the housing 162 is a fractional horsepower electrical motor 164 which drives a cam gear 166 through a gear train 168.

A pair of diametrically opposed studs 170 and 172 protrude from the cam gear 166 and are operative upon rotation of the cam gear 166 to engage the edge of the bypass cam 210 and return the latch member 120 to its latched position and upon further rotation to engage the end of the lock member's second arm 144 releasing the latch member'dog catch 148 from the dog 146. As in the first embodiment, the two diametrically opposed studs 170 and 172 are provided so that the cam gear needs to rotate only through a half of a revolution for each complete operational cycle.

Figure 17:
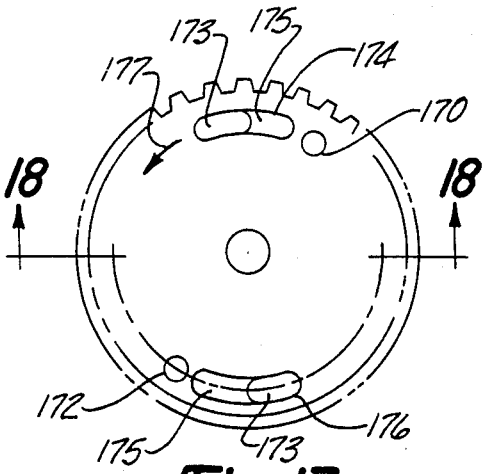
FIG. 17 is a plan view of the cam gear.
Figure 18:
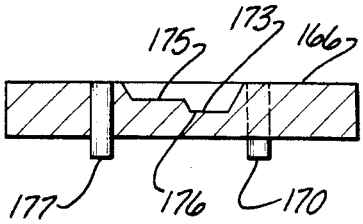
FIG. 18 is a cross-sectional view of the cam gear taken through the cam groove 176.

As shown in FIGS. 17 and 18, the cam gear 166 has a pair of diametrically opposed arcuate cam grooves 174 and 176 provided in its upper surface immediately preceding each of the studs 170 and 172 in the direction of rotation indicated by arrow 177. As shown in greater detail in FIG. 18, both of the cam grooves 174 and 176 are bi-level such that the leading sections 173, are deeper than the trailing sections 175. The bi-level grooves 174 and 176 cooperate with the switch mechanism 178 embodied in the housing 162 to lock or release the latch member 120.

Figure 19:
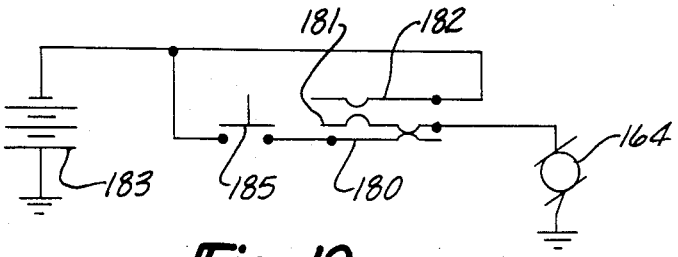
FIG. 19 is a circuit diagram showing the relationship of switch 178 to the motor 164.
Figure 20:
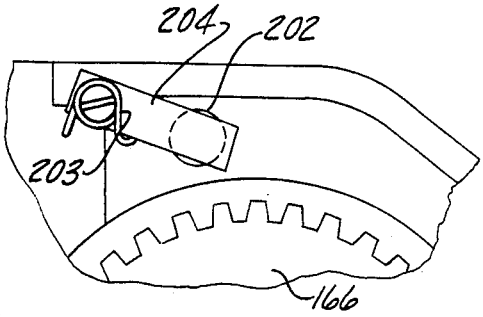
FIG. 20 is a partial cross-sectional view showing the details of the post lock.

In FIG. 16, the electrical lock actuator 142 is shown with the lock mechanism in its locked state with the stud 170 in the position "A" as illustrated on FIG. 15. In this position a cam follower 200 is in the deepest section, section 173, of the cam groove 174 or 176 and the center spring contact 181 is in electrical contact with the lower spring contact 180. The center spring contact 181 is connected to the motor 164, as shown in FIG. 19, while the lower spring contact 180 is connected to the source of electrical power 183 through an unlock switch 185. The spring contact 181 produces a force on the cam follower 200 causing it to follow the contour of the cam gear 166. A post 202, which is slidably received in an aperture in the housing 162, is attached at one end to a third contact spring 182. In the locked state, the post 202 is held in an elevated position by a post lock which may be a spring, as the leaf spring 104 illustrated in FIG. 8 or a post bar 204 biased by a spring 203 as illustrated in FIG. 20. The post bar 204 is functionally the same as the leaf spring 104 and holds the post 202 in its highest elevated position when the lock mechanism is in its locked state. In the highest elevated position of the post 202, the spring contact 182 is disengaged from the spring contact 181. The post bar 204 is displaced from under the post 202 by the bypass cam 210 when the lock mechanism is unlatched, permitting the post 202 to descend to an intermediate level which prevents the post bar 204 from assuming a position under the post 202 until the post 202 is again raised to its highest elevated position by the cam follower 200 acting on the spring contact 182. The spring contact 182 produces a force on the post 202, urging it downward to its lowest permitted level.

Referring now to FIG. 19, when the unlock switch is depressed, the motor 164 is energized through the electrical contact between the spring contacts 180 and 181 which causes the cam gear to rotate displacing the stud 170 from position "A" to position "B", as shown in FIG. 15. During this rotation, the stud 170 engages the end of the lock member's arm 144 disengaging the dog 146 from the dog catch 148, and releasing the latch member 120. The latch member 120 and bypass cam 210, biased by the coil spring 152 and spring 153, will rotate to the open position as shown in FIG. 15.

Figure 21:
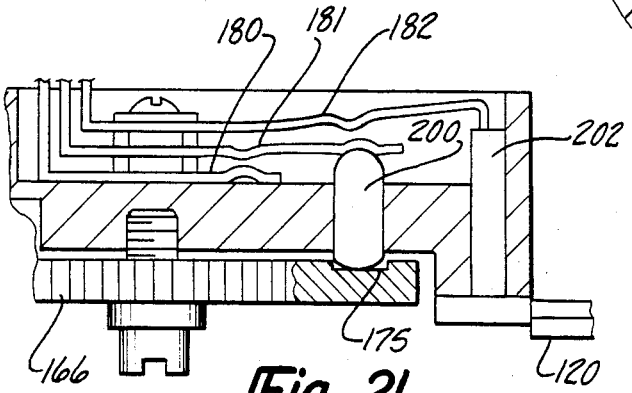
FIGS. 21 through 23 show the state of the switch 178 at various stages of operation.

When the stud 170 reaches position "B", the cam follower 200 rises up in the upper level section 175 of the arcuate bi-level groove 174 or 176 which displaces the spring contact 181 upward a distance sufficient to break the electrical contact between the spring contacts 180 and 181 but not high enough to make electrical contact between the spring contacts 181 and 182, as shown in FIG. 21. In this state, electrical power to the motor 164 is terminated, causing the cam gear 166 to stop with the stud 170 in position "B" and the stud 172 in position "C".

Figure 22:
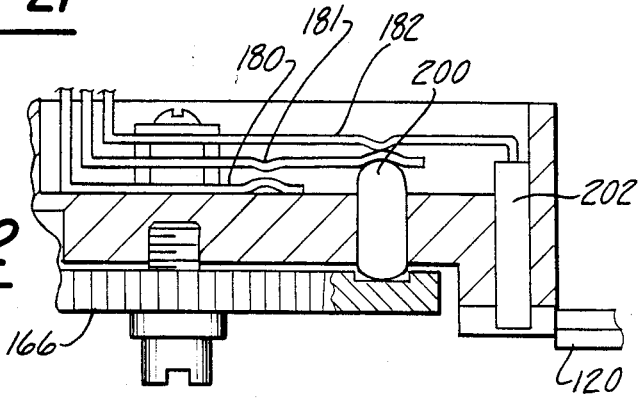
Figure 23:
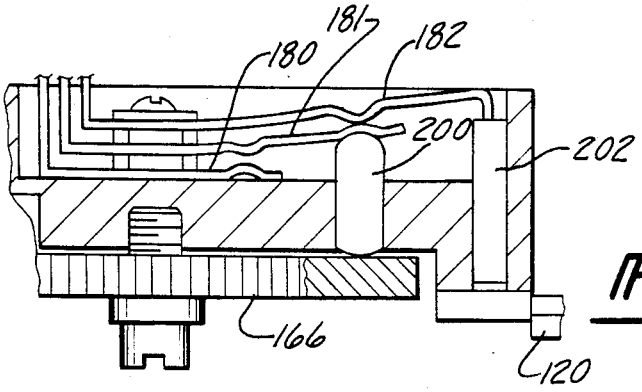

The lock mechanism will remain in this state until an attempt is made to close the rear deck lid. As discussed with reference to the first embodiment, when the rear deck lid is closed sufficiently to displace the latch member 120 and the bypass cam 210 from under the post 202, the post 202 will descend under the bias of the spring contact 182, and the spring contact 182 will make electrical contact with the spring contact 181, as shown in FIG. 22. Electrical contact of the spring contact 182 with the spring contact 181 will provide electrical power to the motor 164 and thereby rotate the stud 172 from position "C" to position "A", as shown in FIG. 15. The stud 172 will engage the edge of the bypass cam 210 and rotate it in a clockwise direction. The edge 214 of the bypass cam 210 will engage the latch member's raised dog 125 and rotate the latch member 120 along with the bypass cam 210 towards the latched position. At the position "D" the stud 172 will have rotated the bypass cam 210 and latch member 120 a distance sufficient to cause the dog 146 to engage the dog catch 148, locking the latch member 120 in the latched position. As the cam gear 166 is being rotated, the cam follower 200 will rise out of the cam groove 174 or 176, raising both spring contacts 181 and 182 to their maximum heights, as shown in FIG. 23. The spring contact 182 will elevate the post 202 to a height sufficient to permit the post bar 204 to be displaced under the post 202 by the spring 203 thereby holding the post 202 in its elevated position. When the stud 172 reaches position "A", the cam follower 200 will fall in the section 173 of the next cam groove, returning the switch mechanism 178 to the state shown in FIG. 16, which is the latched state of the lock mechanism.

If the latch member 120 is released by manually rotating the cam 138 by means of the key lock, the bypass cam 210 will displace the post bar 204 such that when the rear deck lid is closed sufficiently to displace the bypass cam 210 from under the post 202, the post 202 will descend permitting the spring contact 182 to make electrical contact with the spring contact 181 and energizing the motor 164 to lock the latch member 120 in the dog 146, as previously described. If the rear deck lid is slammed down hard enough to lock the latch member 120 in the dog 146, the post 202 will descend energizing the motor which will continue to run until the stud 170 or 172 assumes position "A", as shown in FIG. 15.

If the latch member 120 is released from the dog 146 but the rear deck lid does not open due an accumulated weight, such as a heavy snow, the motor will drive the cam gear 166 until the stud 170 or 172 reaches position "A" and then will stop. The bypass cam will not have moved far enough to displace the post bar 204; therefore, the spring contact 181 remains separated from the spring contact 180 by the cam follower. To activate the lock mechanism, the rear deck lid must be lifted a distance sufficient to cause the bypass cam 210 to displace the post bar 204. This prevents continuous recycling of the lock mechanism when the rear deck lid does not open after the latch member 120 is released.

The function of the bypass cam 210 will be explained with reference to FIGS. 15, 26, 27, and 28. The bypass cam 210 is rotatably connected to the latch member 120 by means of the raised dog 125 and the tab 212, so that the two will pivot together about the pivot pin 122 as shown on FIGS. 15 and 26. The coil spring 152 produces a force biasing the bypass cam 210 towards the latch member 120 so that the raised dog 125 will engage the edge of the bypass cam 210 as shown in FIG. 26.

As illustrated in FIG. 15, if there is an electrical failure or a failure of the electrical lock actuator 142 which results in the cam gear 166 stopping with one of the studs 170 or 172 in the position designated "D", or any other nearby position, the stud will prohibit the bypass cam 210 from rotating to the unlatched position shown. Under this condition, the latch member 120 may still be released to the unlatched position by rotating the key actuated cam 138 to the position shown in FIG. 28. In this position, the ramp surface 139 of the key actuated cam 138 will lift the bypass cam 210 above the upper surface of the dog 125, as shown in FIG. 27. The rotation of the key actuated cam 138 will also displace the lock member 128, releasing the latch member 120 from the dog 146. With the bypass cam 210 in the raised position, the lock member's dog 125 is disengaged and the latch member 120 is free to rotate to the unlatched position, independently of the bypass cam 210, as shown in FIG. 28. As previously indicated, the latch member 120 is independently biased by the spring 153 to rotate to the unlatched position. Therefore, when the rotation of the bypass cam 210 to the unlatched position is prohibited by one of the studs 170 or 172, the electrically actuated lock mechanism may still be manually unlocked using the conventional key lock.

One advantage of the rear deck lid lock mechanism is that the locking of the rear deck lid in its closed position is assured, independent of the closing force. Another advantage of the rear deck lid lock mechanism is that the deck lid does not have to be slammed down to set the latch member in its locked position. Still another advantage of the rear deck lid lock mechanism is that the deck lid may be locked mechanically or electrically. A further advantage is that once the latch member is in the locked position, the electrical locking mechanism is disengaged from the latch member and all subsequent forces applied to the deck lid are sustained by the mechanical elements of the lock and not by any of the components in the electrical locking mechanism. Still another advantage of the lock mechanism is that is may be manually unlatched using the conventional key lock in the event of an electrical failure.

It is intended that the invention not be limited to the specific embodiment illustrated in the drawings and discussed in the detailed description above. It is recognized that a person skilled in the art will be able to conceive different structural arrangements for performing equivalent functions without departing from the spirit of the invention as described above and set forth in the appended claims.

What is claimed is:

1. A locking mechanis for entrapping a lock bar comprising:

a support frame;

a lock member pivotally attached to said support frame, said lock member having a first arm with a lock dog;

latch means having a latch member pivotally attached to said support frame and displaceable between an open and a locked position, said latch member having a dog catch engaging said lock dog to lock said latch member in said locked position, and a catch slot receiving said lock bar in said open position and entrapping said lock bar in said locked position;

resilient means for producing a first force biasing said latch member towards said open position and a second force biasing said lock member towards a locked position engaging said lock dog with said dog catch;

a housing attached to said support frame;

a cam gear rotatably disposed in said housing, said cam gear having a predetermined cam surface;

an electric motor for rotating said cam gear;

at least one stud, protruding from said cam gear, engaging said latch means as said cam gear rotates to displace said latch member to its locked position, said at least one stud further engaging said lock member to disengage said lock dog from said dog catch; and cam actuated switch means responsive to the rotation of said cam gear to provide electrical power to said electric motor, said cam actuated switch means having a first and a third spring contact each adapted to receive electrical power from an external source, and a second spring contact disposed intermediate said first and third spring contacts, said second spring contact being connected to said electric motor and having a first position electrically contacting said first spring contact and electrically separated from said third spring contact, a cam follower disposed between said predetermined cam surface of said cam gear and said second spring contact for displacing said second spring contact from said first position to a second position and a third position in response to the rotation of said cam gear, said second spring contact in said second position being electrically separated from said first spring contact and electrically contacting said third spring contact and said second spring contact in said third position displacing said third spring contact from an initial position to an elevated position, and retainer means for retaining said third spring contact in said elevated position, said retainer means further being responsive to the displacement of said latch member from said open position towards said locked position to release said third spring contact allowing it to return to said initial position.

2. The locking mechanism of claim 1 wherein said cam surface comprises the upper surface of said cam gear and at least one bi-level arcuate cam groove provided in the upper surface of said cam gear, said bi-level cam groove having an intermediate level extending in the direction of the cam gear's rotation a first predetermined circumferential distance relative to said at least one stud and having a contiguous lower level extending a second predetermined circumferential distance in front of said intermediate level in the direction of said cam gear's rotation and wherein said cam follower on said contiguous lower level of said bi-level cam groove allows said second spring contact to assume said first position and make electrical contact with said first spring contact, said cam follower on said intermediate level of said bi-level cam groove raises said second spring contact to said second position, and said cam follower on said surface of said cam gear raises said second spring contact to said third position and raises said third spring contact to said elevated position.

3. The locking mechanism of claim 2 wherein said at least one stud comprises two studs diametrically opposed to each other on the surface of said cam gear and wherein said at least one bi-level cam groove comprises two bi-level cam grooves diametrically opposed to each other.

4. The locking mechanism of claim 3 including a key actuated cam rotatably attached to said support frame adjacent to said lock member, said key actuated cam operative to pivotally displace said lock member a distance sufficient to disengage said lock dog from said dog catch in response to being rotated by a key operated lock.

5. The locking mechanism of claim 1 including a key actuated cam rotatably attached to said support frame adjacent to said lock member, said key actuated cam operative to pivotally displace said lock member a distance sufficient to disengage said lock dog from said dog catch in response to being rotated by a key operated lock.

6. The locking mechanism of claim 5 wherein said latch means comprises a bypass cam pivotally attached to said support bracket adjacent to said latch member and means for mechanically engaging said bypass cam with said latch member forcing them to pivot together, and wherein said at least one stud engages said bypass cam to displace said latch member to tis locked position, and wherein said key actuated cam comprises means for disengaging said latch member from said bypass cam.

7. The locking mechanism of claim 6 wherein said means for mechanically engaging comprises a raised dog provided on said latch member engaging one edge of said bypass cam to prohibit independent rotation of said latch member towards the unlocked position and a tab provided on said bypass cam engaging an edge of said latch member to prohibit independent rotation of said bypass cam towards the unlocked position and wherein said means for disengaging is a ramp surface displacing said bypass cam from said latch member in response to the rotation of said key actuated cam, said ramp surface displacing said bypass cam a distance sufficient to disengage said one edge of said bypass cam from said raised dog permitting said latch member to be displaced to the unlocked position independent of said bypass cam.

8. A locking mechanism for engaging a lock bar to secure a rear deck lid of an automotive vehicle having a key operated lock, said locking mechanism comprising:

a support bracket;

a latch member pivotally attached to said support bracket, said latch member having a catch slot engaging said lock bar to lock said rear deck lid when said latch member is in a locked position;

a bypass cam pivotally attached to said support bracet adjacent to said latch member;

means for mechanically engaging said bypass cam with said latch member forcing them to pivot together;

lock means pivotally attached to said support member, said lock means having a first position latching said latch member in said locked position and being displaceable to a second position releasing said latch member;

means for independently biasing said bypass cam and said latch member towards an open position in which said lock bar is disengaged from said catch slot, said means for independently biasing further biasing said lock means to latch said latch member in said locked position;

an electrical actuator responsive to the engagement of said lock bar in said catch slot to pivotally displace said latch member to said locked position and responsive to an unlock signal for displacing said lock means to said second position to release said latch member from its locked position; and a cam movably attached to said support bracket and responsive to the actuation of said key operated lock to displace said lock means to said second position releasing said latch member from its locked position and to displace said bypass cam disabling said means for mechanically engaging said bypass cam with said latch member thereby permitting permit said latch member to independently pivot to said open position.

9. The locking mechanism of claim 8 wherein said electrical actuator comprises:

a cam gear having a multilevel cam surface;

an electric motor for rotating said cam gear;

at least one stud protruding from said cam gear operative to engage said bypass cam and to displace said bypass cam and said latch member to said locked position, and said at least one stud further being operative to engage said lock means to displace said lock means to said second position; and switch means responsive to the the displacement of said bypass cam and said latch member towards said locked position for providing electrical power to said electric motor to rotate said cam gear displacing said bypass cam and said latch member to said locked position and responsive to a first contour of said multilevel cam surface to terminate the electrical power to said motor after said latch member is in said locked position and responsive to an unlock signal to provide electrical power to said motor to rotate said cam gear to temporarily displace said lock means to said second position and responsive to a second contour of said multilevel cam surface to terminate the electrical power to said motor after said lock means has returned to said first position.

10. A locking mechanism for engaging a lock bar to secure a rear deck lid of an automotive vehicle having a key operated lock, said locking mechanism comprising:

a support bracket;

a latch member pivotally attached to said support bracket, said latch member having a catch slot engagable with said lock bar in an open position and entrapping said lock bar to lock said rear deck lid in a closed position;

a bypass cam pivotally attached to said support bracket adjacent to said latch member;

means for mechanically engaging said bypass cam with said latch member forcing them to pivot together;

lock means pivotally attached to said support bracket, said lock means having a first position latching said latch member in said locked position and displaceable to a second position releasing said latch member;

means for biasing said latch member and said bypass cam towards said open position and said lock means to said first position, said means for biasing further biasing said bypass cam towards said latch member;

an electric actuator responsive to the displacement of said latch member from its open position by said lock bar to pivotally displace said bypass cam and latch member to said locked position and responsive to an unlock signal for displacing said lock means to said second position releasing said latch member from said lock position; and a key actuated cam for displacing said lock means to said second position in response to being rotated by said key operated lock, said key actuated cam having means for disabling said means for mechanically engaging to permit said latch member to pivot independently of said bypass cam.

* * * * *

UNITED STATES PATENT AND TRADEMARK OFFICE

CERTIFICATE OF CORRECTION

PATENT NO. : 4,652,027

DATED : March 24, 1987

INVENTOR(S) : Norman G. Quantz

It is certified that error appears in the above-identified patent and that said Letters Patent is hereby corrected as shown below:

Column 2, line 18, delete "produces" and insert ---- produce ----.

Column 3, line 14, after "176" insert ---- taken along line 18-18 of Fig. 17 ----.

Column 3, line 16, after "of" insert ---- the ----.

Column 3, line 44, delete "a" and insert ---- the ----.

Column 3, line 59, delete "The" and insert ---- A ----.

Column 5, line 14, delete "in" and insert ---- is ----.

Column 5, line 18, delete "contact springs" and insert ---- spring contacts ----.

Column 5, line 19, delete "contact springs" and insert ---- spring contacts ----.

Column 5, line 22, delete "contact" and insert ---- contacts ----.

Column 5, line 28, line delete "contact spring" and insert ---- spring contact ----.

Column 5, line 30, delete "contact" and insert ---- spring ----.

UNITED STATES PATENT AND TRADEMARK OFFICE

CERTIFICATE OF CORRECTION

PATENT NO. : 4,652,027

DATED : March 24, 1987

INVENTOR(S) : Norman G. Quantz

It is certified that error appears in the above-identified patent and that said Letters Patent is hereby corrected as shown below:

Column 5, line 31, delete "spring" and insert ---- contact ----.

Column 5, line 34, delete "contact spring" and insert ---- spring contact ----.

Column 5, line 51, delete "contact spring" and insert ---- spring contact ----.

Column 6, line 15, delete "can" and insert ---- cam ----.

Column 6, line 20, delete "contact springs" and insert ---- spring contacts ----.

Column 7, line 12, after "26" insert ---- is ----.

Column 7, line 45, after "to" insert ---- the ----.

Column 7, line 51, delete "26" and insert ---- 126 ----.

Column 8, line 17, after "and" insert ---- also biases ----.

Column 8, line 20, after "148" insert a comma ---- , ----, same line, delete "on" and insert ---- in ----.

Column 8, line 39, delete "12" and insert ---- 112 ----.

UNITED STATES PATENT AND TRADEMARK OFFICE

CERTIFICATE OF CORRECTION

PATENT NO. : 4,652,027

DATED : March 24, 1987

INVENTOR(S) : Norman G. Quantz

It is certified that error appears in the above-identified patent and that said Letters Patent is hereby corrected as shown below:

Column 8, line 67, delete "on" and insert ---- in ----.

Column 9, line 1, delete "the" (second occurrence) and insert ---- a ----.

Column 9, line 2, delete "the" and insert ---- a ----.

Column 9, line 11, delete "contact spring" and insert ---- spring contact ----.

Column 9, line 13, after the comma "," insert ---- such ----.

Column 9, line 14, after "8" insert a comma ---- , ----.

Column 9, line 36, after "member's" insert ---- second ----.

Column 10, line 27, after "descend" insert a comma ---- , ----.

Column 10, line 28, after "motor" insert a comma ---- , ----.

Column 10, line 67, delete "lock" and insert ---- latch ----.

In the Claims

Column 11, line 35, delete "mechanis" and insert ---- mechanism ----.

UNITED STATES PATENT AND TRADEMARK OFFICE

CERTIFICATE OF CORRECTION

PATENT NO. : 4,652,027

DATED : March 24, 1987

INVENTOR(S) : Norman G. Quantz

It is certified that error appears in the above-identified patent and that said Letters Patent is hereby corrected as shown below:

Column 12, line 67, delete "bracket" and insert ---- frame ----.

Column 13, line 3, delete "tis" and insert ---- its ----.

Column 13, line 31, delete "cet" and insert ---- cket ----.

Column 13, line 59, delete "permit".

Column 14, line 55, delete "lock" and insert ---- locked ----.

Signed and Sealed this

Fifteenth Day of December, 1987

*Attest:*

DONALD J. QUIGG

*Attesting Officer*

*Commissioner of Patents and Trademarks*